United States Patent [19]

Nikaido et al.

[11] Patent Number: 4,597,318

[45] Date of Patent: Jul. 1, 1986

[54] WAVE GENERATING METHOD AND APPARATUS USING SAME

[75] Inventors: Masataka Nikaido, Takatsuki; Kinji Kawamoto, Yahata; Kazuhiro Murase, Hirakata; Tetsuhiko Kaneaki, Ashiya; Tatsuya Adachi, Hirakata; Sakurako Matsuda, Joyo, all of Japan

[73] Assignee: Matsushita Electric Industrial Co., Ltd., Osaka, Japan

[21] Appl. No.: 571,535

[22] Filed: Jan. 17, 1984

[30] Foreign Application Priority Data

Jan. 18, 1983 [JP] Japan ..... 58-6312
Jul. 20, 1983 [JP] Japan ..... 58-133442

[51] Int. Cl.[4] ..... G10H 1/08; G10H 7/00; G10L 5/02

[52] U.S. Cl. ..... 84/1.22; 84/1.01; 381/51

[58] Field of Search ..... 84/1.01, 1.19–1.22; 381/36–53

[56] References Cited

U.S. PATENT DOCUMENTS 4,227,435 10/1980 Ando et al. ..... 84/1.19
4,282,790 8/1981 Wachi ..... 84/1.21
4,351,219 9/1982 Bass ..... 84/1.21
4,397,210 8/1983 Finch ..... 84/1.22 X
4,418,600 12/1983 Wachi ..... 84/1.19
4,440,058 4/1984 Bass et al. ..... 84/1.19 X
4,446,770 5/1984 Bass ..... 84/1.01
4,487,098 12/1984 Mishima ..... 84/1.22 X

*Primary Examiner*—Stanely J. Witkowski
*Attorney, Agent, or Firm*—Wenderoth, Lind & Ponack

[57] ABSTRACT

A wave generating method and a wave generating apparatus using the method are arranged such that plurality of wave samples, each being generated successively, are respectively weighted by, for example, being multiplied by a plurality of wave functions generated corresponding to the plurality of wave samples. The plurality of weighted wave samples are summed to obtain a desired wave. The kind of each of the plurality of wave samples generated successively is changed at each time when the value of corresponding one of the plurality of wave functions becomes zero. Therefore, the apparatus includes wave generators for generating the wave samples successively, wave function generators for generating the wave functions successively, multipliers for multiplying the wave samples by the wave functions respectively, an adder for adding all of the outputs of the multipliers to generate the desired wave, and a wave changing circuit for changing the kind of each of the wave samples when the corresponding one of the wave functions becomes zero.

21 Claims, 20 Drawing Figures

WAVE GENERATING METHOD AND APPARATUS USING SAME

BACKGROUND OF THE INVENTION

1. Field of the Invention

This invention relates to a wave generating apparatus which generates speech sound or musical sound naturally, and is usable for speech synthesizers and electric musical instruments.

2. Description of the Prior Art

In the conventional speech synthesizer, which reads out a memorized wave repeatedly for a predetermined times and then changes the wave to another one successively, two waves which have spectra different from each other are combined at the changing point, so the tone color of the resultant wave has discontinuities and unwanted noises come out.

To avoid these inconveniences, an interpolating method between plural waves has been introduced in Japanese Patent Application No. 55-155053/1980. But, this method is not satisfactory enough to obtain a wave which is adequately continuous and free from noise.

SUMMARY OF THE INVENTION

An object of the present invention is to provide a wave generating method and an apparatus using same which generates waves whose transitions from one wave to another are smooth and independent of the number of the generated waves.

Another object of the present invention is to provide a wave generating method and an apparatus using same which generates waves having natural fluctuations with time.

Still another object of the present invention is to provide a wave generating method and an apparatus using same which generates waves approximately the same as those of the sounds of the existing acoustic instruments using a small amount of data.

These objects can be accomplished by a wave generating method of the invention comprising the steps of: generating a plurality of wave samples successively; weighting said plurality of wave samples by predetermined quantities respectively, each of said predetermined quantities changing with time; adding all of the weighted wave samples to obtain a wave; and changing the kind of each of said plurality wave samples at each time when respective one of said predetermined quantities becomes zero.

The above objects can be accomplished more preferably by a wave generating method of the invention comprising the steps of: generating a plurality of wave samples, each being generated successively; generating a plurality of window functions corresponding to said plurality of wave samples; multiplying said plurality of wave samples by said plurality of window functions, respectively; adding all of said multiplied results to obtain a wave; and changing the kind of each of said plurality of wave samples when corresponding one of said plurality of window functions becomes zero.

According to the above methods, the present invention provides a wave generating apparatus comprising: a plurality of wave generating means for generating a plurality of wave samples, each being generated successively; a plurality of window function generating means for generating a plurality of window functions corresponding to said plurality of wave samples; a plurality of multiplying means for multiplying said plurality of wave samples by said plurality of window functions; an adding means for adding all of outputs of said plurality of multiplying means to obtain a wave; and at least one wave changing means for producing a wave changing signal applied to said plurality of wave generating means thereby to change the kind of each of said plurality of wave samples when corresponding one of said plurality of window functions becomes zero.

By modifying this apparatus, the present invention also provides a wave generating apparatus comprising: wave generating means for generating a plurality of wave samples successively and differential wave samples having differential values between two successive wave samples of said plurality of wave samples generated successively; window function generating means for generating a plurality of window functions successively; multiplying means for successively multiplying said differential wave samples by said plurality of window functions, respectively; adding means for successively adding outputs of said multiplying means with said plurality of wave samples to obtain a wave; and wave changing means for changing the kinds of said plurality of wave samples when said plurality of window functions become zero.

The above and other objects and features of the present invention will become more apparent from consideration of the following detailed description taken with the accompanying drawings in which:

DESCRIPTION OF THE PREFERRED EMBODIMENTS

Figure 20:
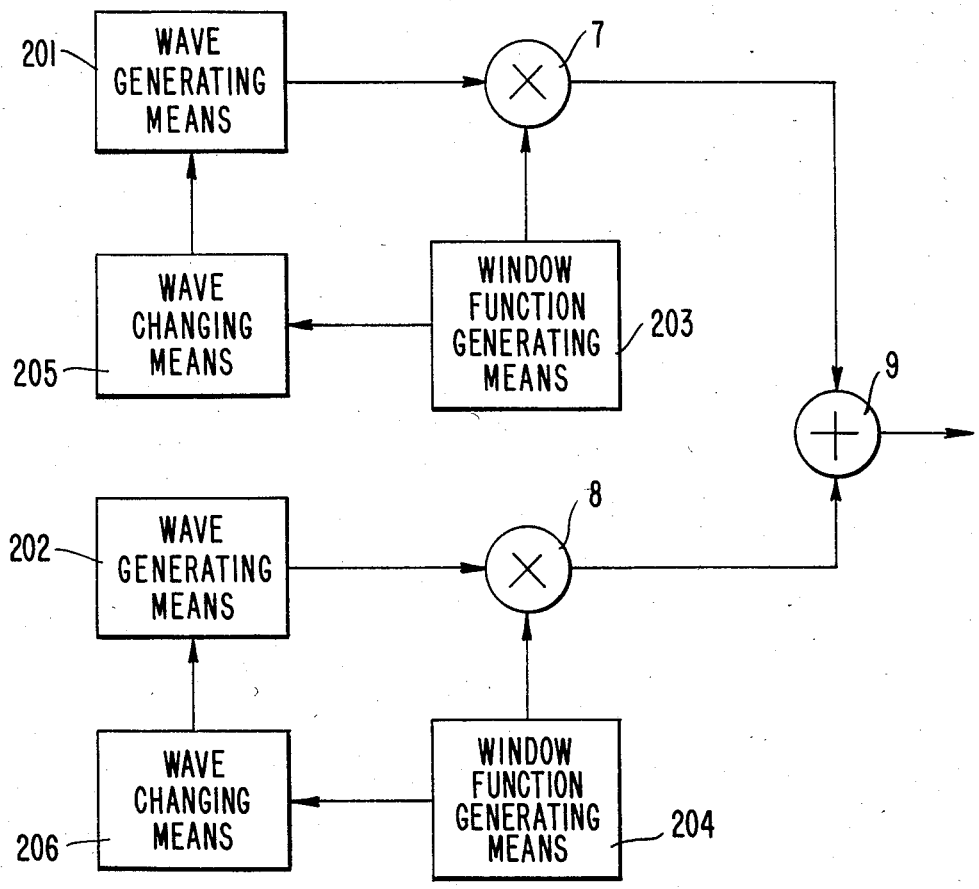
FIG. 20 is a schematic block diagram showing an outline of the present invention.

FIG. 20 is a schematic block diagram of the present invention. Referring to FIG. 20, elements 201 and 202 are wave generating means which generate plural kinds of waves successively. Elements 203 and 204 are window function generating means which generate window functions. Elements 7 and 8 are multipliers which multiply the waves generated by the wave generating means 201 and 202 with the window functions generated by the window function generating means 203 and 204, respectively. Element 9 is an adder which adds outputs of the multipliers 7 and 8. Elements 205 and 206 are wave changing means which produce wave changing signals applied to the wave generating means 201 and 202, respectively, when the values of the window functions generated by the window function generating means 203 and 204 are zero, respectively. More detailed explanation will be described by referring to FIG. 1.

Figure 1:
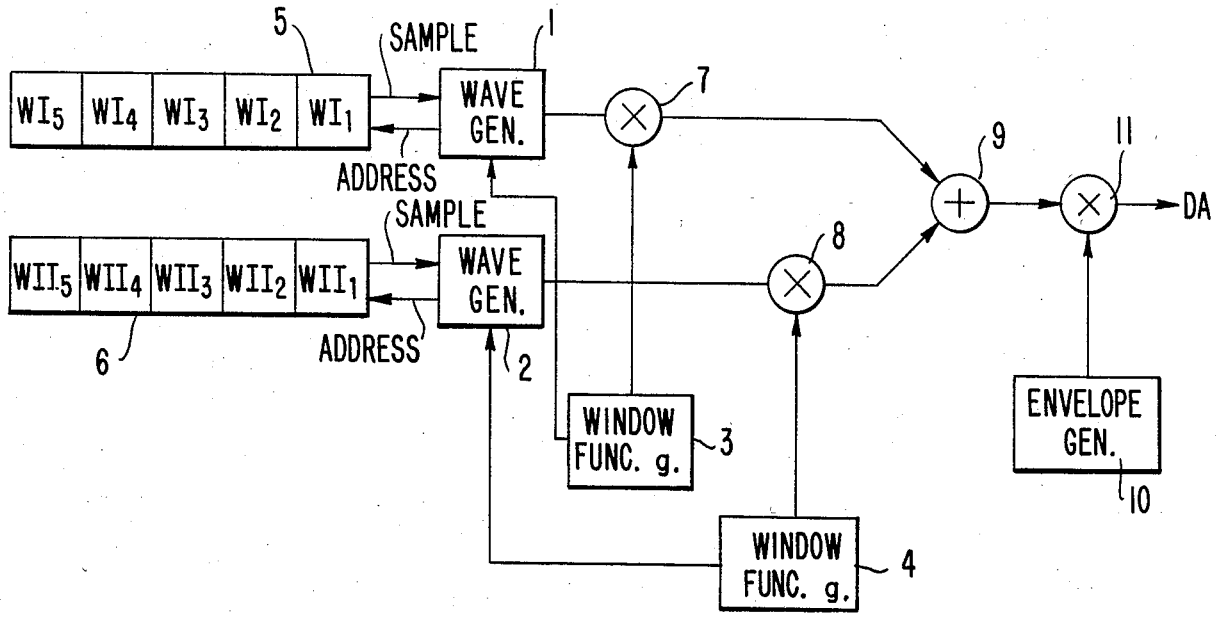
FIG. 1 is a schematic block diagram of an embodiment of a wave generating apparatus of the present invention.

FIG. 1 is a block diagram showing an embodiment of a wave generating apparatus of the invention. Referring to FIG. 1, elements 1 and 2 are wave generators which generate waves by reading out original wave samples in a predetermined order. The wave generator 1 reads out original wave samples $WI_1$–$WI_5$ stored in a wave memory 5. The wave generator 2 reads out original wave samples $WII_1$–$WII_5$ stored in a wave memory 6. The original waves $WI_1$–$WI_5$ and $WII_1$–$WII_5$ are obtained by taking out one period length from objective sound waves of acoustic instruments such as, for example, piano and clarinet.

In this embodiment, timing locations in the objective sound waves of $WI_1$–$WI_5$ and $WII_1$–$WII_5$ are in the order of $WI_1$, $WII_1$, $WI_2$, $WII_2$, $WI_3$, $WII_3$, . . . , $WI_5$, $WII_5$. And, every adjacent two wave samples of these ten wave samples are spaced at an interval of some period lengths in the objective sound waves. The length of each side of the triangles corresponds to the interval of each adjacent two waves of $WI_1$, $WII_1$, $WI_2$, $WII_2$, . . . , $WI_5$, $WII_5$ in the objective sound waves. The original wave $WI_1$ or $WII_1$ is taken out from the attack region of an objective sound wave, while the original wave $WI_5$ or $WII_5$ is taken out from the end region of the objective sound wave.

Also, if necessary, the original waves $WI_1$–$WI_5$ and $WII_1$–$WII_5$ may be so processed that the harmonic components of the original waves $WI_1$–$WI_5$ and $WII_1$–$WII_5$ have predetermined phases. This phase control process of waves can be realized by using the Fast-Fourier transformation algorithm. The read out wave samples are applied to multipliers 7 and 8, respectively. Elements 3 and 4 are window function generators. In this embodiment, each of the window function generators 3 and 4 generates window functions and a wave changing signal when the values of the window functions become zero. Explanation of the window functions will be described later.

Each of the multipliers 7 and 8 multiply a sample of the read out wave samples with a sample of the window functions. An adder 9 adds the products outputted from the multipliers 7 and 8. An envelope generator 10 and a multiplier 11 give an envelope variation to the output wave of the adder 9. An output wave sample of the multiplier 11 is converted to an analog wave by a digital-to-analog converter.

Figure 2:
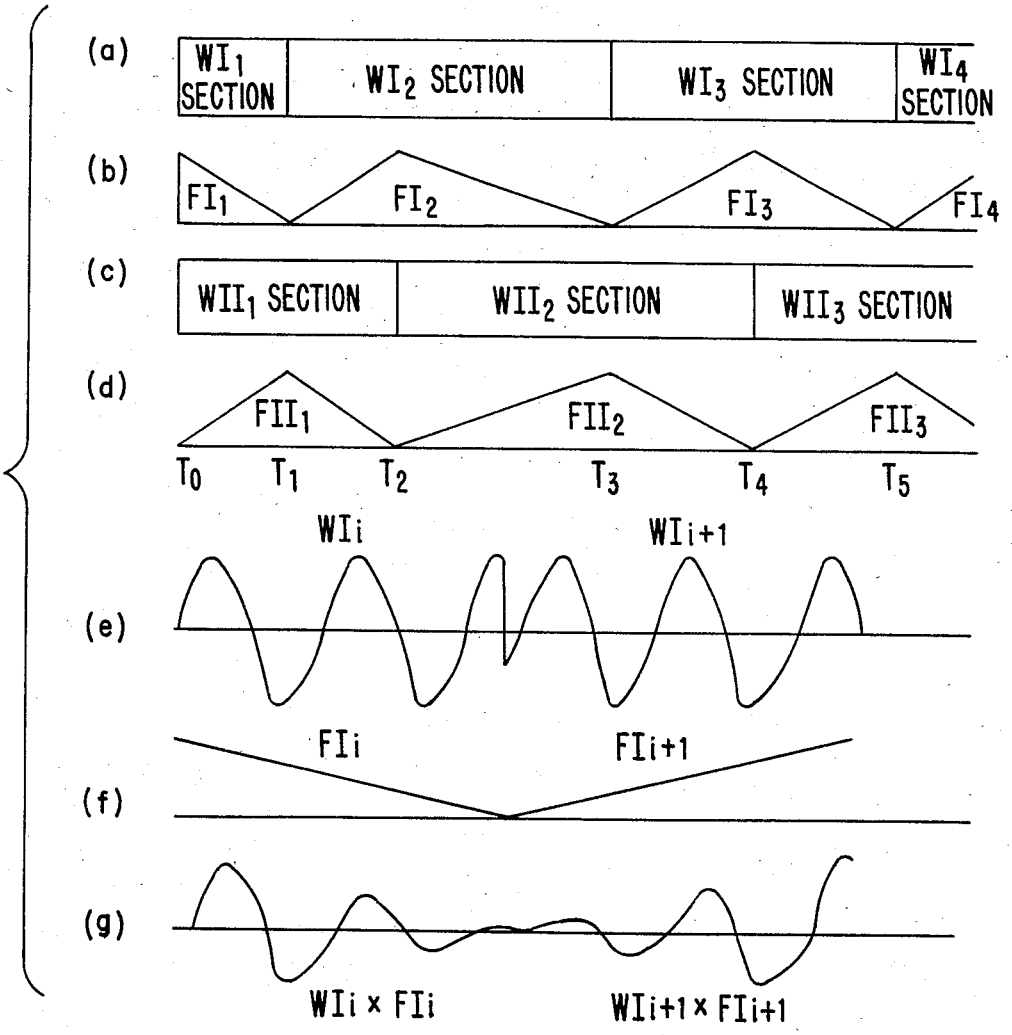
FIG. 2 and FIG. 3 are diagrams used to explain calculations for generating waves.

Next, the original waves and the window functions will be explained. Each of the waves $WI_1$–$WI_5$ and $WII_1$–$WII_5$ consists of one period of natural speech wave or musical sound wave. As shown in FIG. 2(*a*), each of the waves $WI_1$–$WI_5$ is repeated in the respective section of $WI_1$–$WI_5$. On the other hand, window functions $FI_1$–$FI_5$ are shown in FIG. 2(*b*). They are triangular. As shown in FIGS. 2(*a*)–(*d*), the transition timings from one section to the next of the waves $WI_1$–$WI_5$ are different from those of the waves $WII_1$–$WII_5$, and the phases of the window functions $FI_1$–$FI_5$ are different from those of the window functions $FII_1$–$FII_5$.

When the sample values of an original wave $WI_i$ (i=any integer) and a window function $FI_i$ at a timing nT are $WI_i(nT)$ and $FI_i(nT)$, respectively, and the sample values of an original wave $WII_j$ (j=any integer) and a window function $FII_j$ at the timing nT are $WII_j(nT)$ and $FII_j(nT)$, respectively, then the sample value of an output wave $W_0(nT)$ is expressed as follows:

$$W_O(nT) = WI_i(nT) \times FI_i(nT) + WII_j(nT) \times FII_j(nT) \quad (1)$$

where, j=i or i−1

In the $WI_i$ section, the original wave $WI_i$ is read out repeatedly $R_i$ times. The value $R_i$ depends on the window function and can be either integer or non-integer. When $R_i$ is non-integer, the output of the wave generator 1 changes from an intermediate point of the original wave $WI_i$ to an intermediate point of the original wave $WI_{i+1}$.

When the waveforms of the $WI_i$ and $WI_{i+1}$ are not exactly the same, it is impossible to change the wave from $WI_i$ to $WI_{i+1}$ without any discontinuity. But the read out wave changes from the original wave $WI_i$ to the original wave $WI_{i+1}$ at the time that the window function changes from $FI_i$ to $FI_{i+1}$, and the read out wave changes from the original wave $WII_i$ to the original wave $WII_{i+1}$ at the time that the window function changes from $FII_i$ to $FII_{i+1}$. In addition, at these changing points the values of the window functions are zero. So, the product $WI_i \times FI_i$ changes to $WI_{i+1} \times FI_{i+1}$ smoothly, and the product $WII_j \times FII_j$ also changes to $WII_{j+1} \times FII_{j+1}$ smoothly. In other words, whatever the phase and the number of repeating times the original waves $WI_i$ and $WII_j$ take, the products $WI_i \times FI_i$ and $WII_j \times FII_j$ are free from unwanted noises, because they have no discontinuity either in instantaneous values or in differentiation coefficients of the products data. This is shown in FIGS. 2(*e*), (*f*) and (*g*). FIG. 2(*e*) shows the read out waves, FIG. 2(*f*) shows the window functions, and FIG. 2(*g*) shows the products of the read out waves and the window functions. Time axes of FIGS. 2(*e*), (*f*) and (*g*) are expanded compared with those of FIGS. 2(*a*), (*b*), (*c*) and (*d*).

In the above case, the waves $WI_i$ in the section $WI_i$ are generated by reading out an original wave repeatedly from the memory 5. However, the waves can be generated by reading a whole of waves of the section $WI_i$ stored in the memory 5, and in this case, also, no noises come out at the joint of sections. Also, the original waves $WI_i$ and $WI_{i+1}$ can have same wave shape with different initial phases, and in this case memories can be saved, because the wave $WI_i$ and $WI_{i+1}$ can be generated by reading out from the same memory area at different start addresses. These controls can be realized by modulating the address codes generated by the wave generators 1 and 2.

Figure 3:
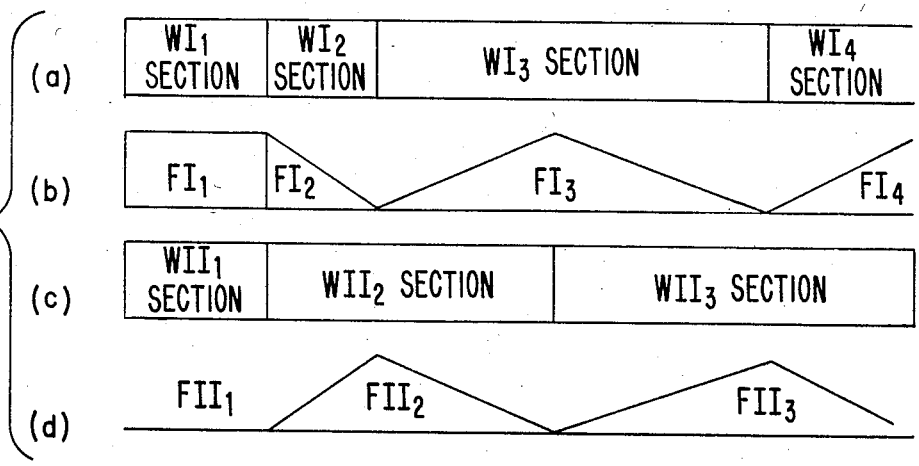

FIGS. 3(*a*), (*b*), (*c*) and (*d*) show another example of wave sections and window functions. Referring to FIG.

3(*b*), the value of the window function $FI_1$ is unity in the section $WI_1$. The original wave $WI_1$ is outputted from the multiplier 7 without any changes. On the other hand, the values of the window function $FII_1$ is zero, so the original wave $WII_1$ is not necessary. At the transition from the section $WI_1$ to the section $WI_2$, the value of the window function is not zero. Accordingly, the continuity is necessary between the original value $WI_1$ and the original wave $WI_2$. That is, the sections $WI_1$ and $WI_2$ are regarded as one section, and the window function is regarded as trapezoidal in combination with $FI_1$ and $FI_2$.

In the cases as shown in FIGS. 2 and 3, $$FI_i+FII_j=1 \tag{2}$$

where, j=i or i−1.

Therefore, the following equation can be used instead of the equation (1):

$$WO(nT)=WI_i(nT)+\{WII_j(nT)-WI_i(nT)\}FII_j(nT) \tag{3}$$

where, j=i or i−1, or $$WO(nT)=\{WI_i(nT)-WII_j(nT)\}FI_i(nT)+WII_j(nT) \tag{4}$$

where, j=i or i−1

That is, the product of the difference value of the two waves $WI_i$ and $WII_j$ and the window function is added to one of the two waves $WI_i$ and $WII_j$.

Next, referring to FIG. 2, we will explain how to execute the interpolation between the original wave $WI_i$ and $WII_{i+1}$ or between the original wave $WII_i$ and $WI_i$. Since the window function $FI_1$ decreases in the period $T_0-T_1$, the amplitude of the wave obtained by multiplying $WI_1$ and $FI_1$ decreases linearly. On the other hand, since the window function $FII_1$ increases in the same period the amplitude of the wave obtained by multiplying $WII_1$ and $FII_1$ increases linearly.

Almost periodic waves like musical sound waves can be considered as a sum of harmonic components. Furthermore, since all the processes used in this invention are linear (i.e. multiplication and addition), we can consider each two components of the same harmonic order of the original waves $WI_1$ and $WII_1$ as a pair. In the case that the phases of each pair of harmonics are equal, the amplitude of each harmonic component of the resultant wave (i.e. the sum of the product $FI_1\times WI_1$ and the product $FII_1\times WII_1$) varies linearly from that of the original wave $WI_1$ to that of the original wave $WII_1$. The phases of the harmonics of the resultant wave are the same as those of the two original waves. That is to say, only the amplitude of each harmonic component is linearly interpolated.

Figure 4:
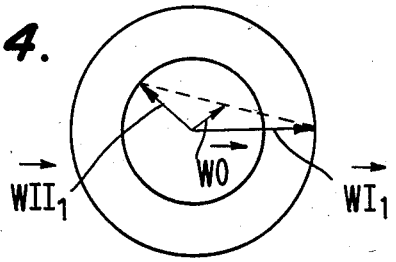
FIG. 4 and FIG. 16 are diagrams used to explain interpolations in phase and amplitude.

In the case that the phases of each harmonic components of the wave $WI_1$ and $WII_1$ are not equal, it is necessary to consider the interpolation as a vector interpolation which includes also the phases of the waves instead of the simple amplitude interpolation. This is shown in FIG. 4. In FIG. 4, the end of the resultant vector $\vec{W}O$ moves on the straight line which connects the ends of the vectors $\vec{W}I_i$ and $\vec{W}II_1$, $\vec{W}O$, $\vec{W}I_1$ and $\vec{W}II_1$ are the vector descriptions of the complex Fourier coefficients of the harmonic components of the wave WO, $WI_1$ and $WII_1$, respectively.

Figure 5:
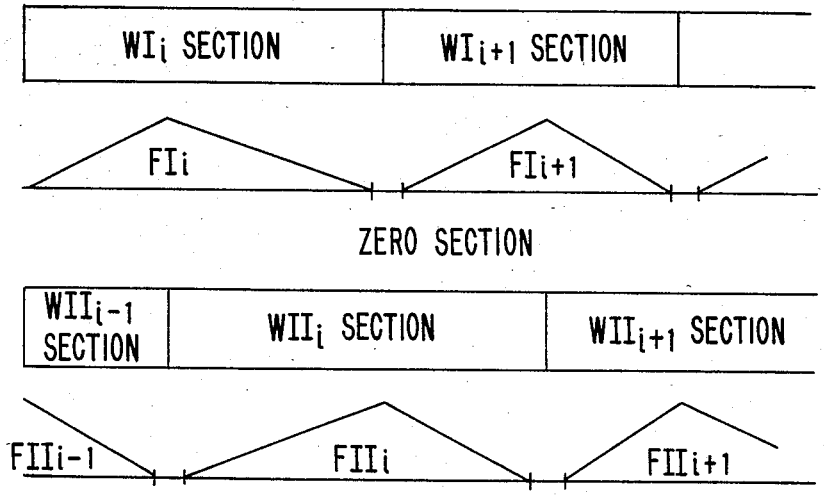
FIG. 5 and FIG. 6 are diagrams used to explain calculations for generating waves by using other window functions.
Figure 6:
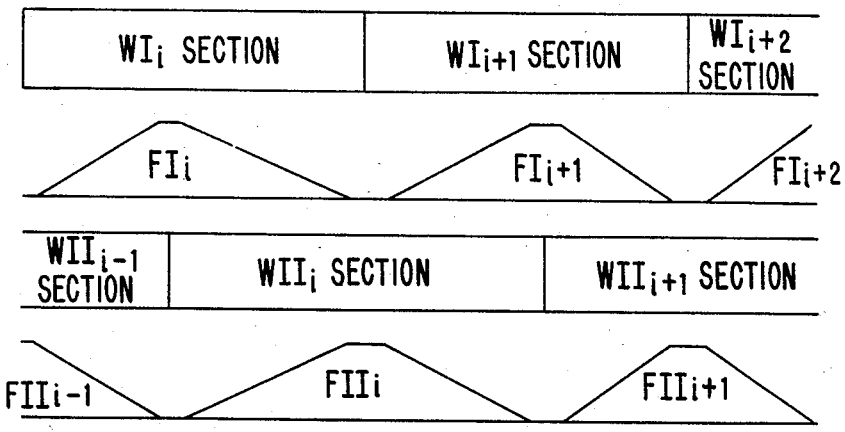

FIGS. 5 and 6 show other examples of window functions. Zero sections whose values are constantly zero are provided between $FI_i$ and $FI_{i+1}$, and the read out wave changes from the original wave $WI_i$ to the original wave $WI_{i+1}$ in that sections. Therefore, even if there are discontinuities between the wave $WI_i$ and the wave $WI_{i+1}$, no discontinuity occurs at a junction of $WI_i\times FI_i$ and $WI_{i+1}\times FI_{i+1}$. The zero sections cause the interpolation between the wave $WI_i$ and the wave $WII_i$ to deviate slightly from the linear interpolation, but no problems occur for practical use.

In FIG. 6, $FI_i$ and $FII_i$ are trapezoidal, and, $$FI_i+FII_i=1 \tag{5}$$

or $$FI_i+FII_{i+1}=1 \tag{6}$$

are assumed. In this case, one of the two waves is outputted at the top region of each trapezoid. At the slope portions of each trapezoid, linear interpolation of the both waves are executed.

Figure 7:
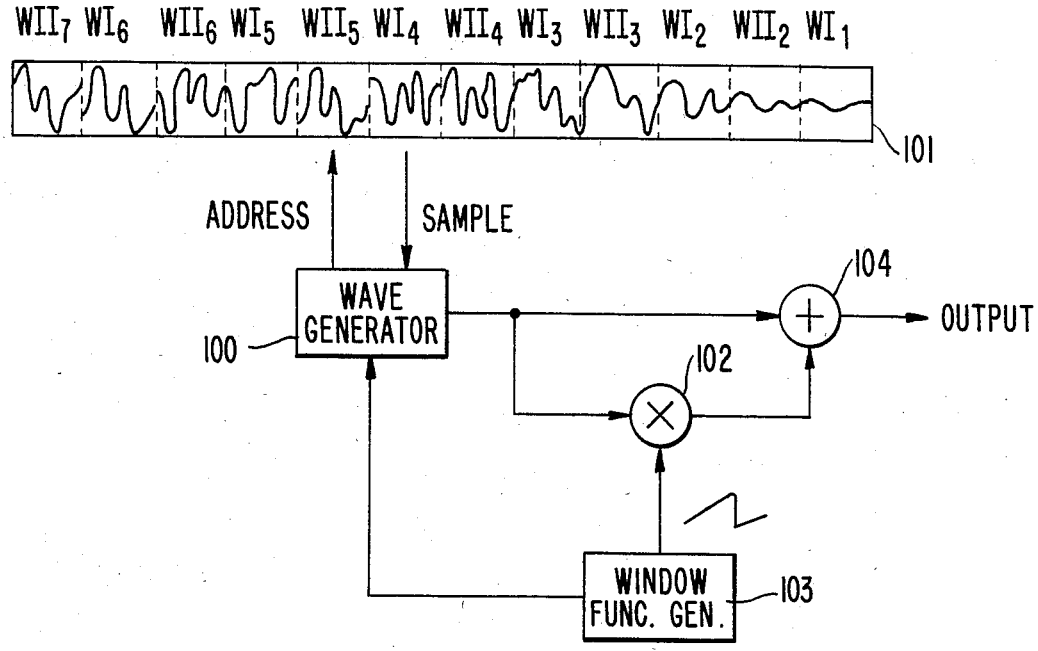
FIG. 7 is a schematic block diagram of another embodiment of a wave generating apparatus of the present invention.

FIG. 7 shows another embodiment of this invention. 101 is a memory which stores the original waves of each section, 100 is a wave generator which supplies address data to the memory 101 and reads out the original wave samples corresponding to the address data from the memory 101 and outputs the wave samples and the differences of the wave samples.

The output wave samples of the wave generator 100 are applied to a multiplier 102 and an adder 104. The outputs of the multiplier 102 are applied to the adder 104. The outputs of the adder 104 becomes interpolated wave data. 103 is a window function generator which supplies window function data to the multiplier 103 and applies a wave changing command to the wave generator 100.

Figure 8:
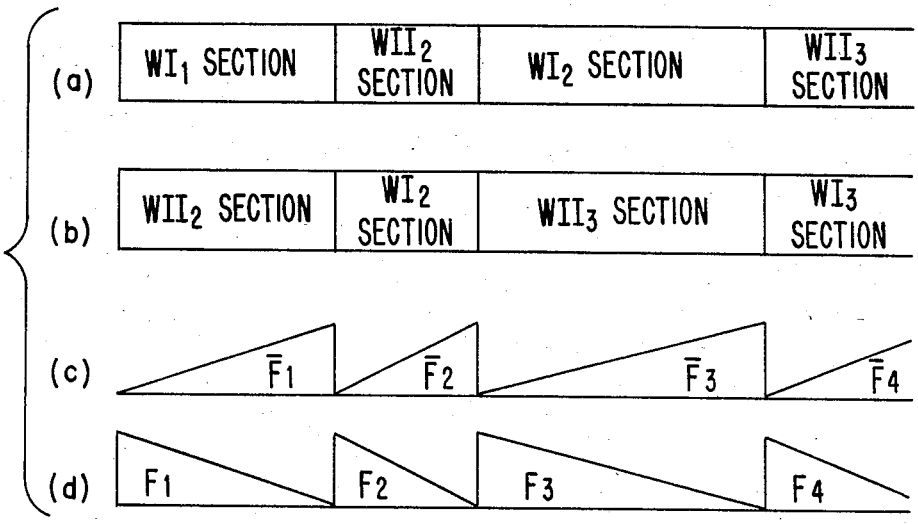
FIG. 8 is a diagram used to explain calculations for generating a wave by the apparatus of FIG. 7.

In the memory 101, the waves $WI_1$–$WI_6$, $WII_1$–$WII_6$ are stored in order. FIG. 8 shows the steps of the calculation of this embodiment, in which:

$$\begin{aligned}
WO(nT) &= WI_1(nT)+\{WII_2(nT)-WI_1(nT)\}F_1\ (F_1\text{ section}) \\
WO(nT) &= WII_2(nT)+\{WI_2(nT)-WII_2(nT)\}F_2\ (F_2\text{ section}) \\
WO(nT) &= WI_2(nT)+\{WII_3(nT)-WI_2(nT)\}F_3\ (F_3\text{ section}) \\
&\ \ \vdots \\
WO(nT) &= WI_i(nT)+\{WII_{i+1}(nT)-WI_i(nT)\}F_{2i-1}\ (F_{2i-1}\text{ section}) \\
WO(nT) &= WII_{i+1}(nT)+\{WI_{i+1}(nT)-WII_{i+1}(nT)\}F_{2i}\ (F_{2i}\text{ section})
\end{aligned} \tag{7}$$

By executing the above calculations for each wave sample, the smooth transition from the original wave $WI_i$ to the original wave $WII_{i+1}$ or from the original wave $WII_i$ to the original wave $WI_i$ is realized. In this case, the window functions $F_{2i}$ and $F_{2i-1}$ decreases linearly. Instead of equations (7), the following equations derived from equations (7), by using $F_{2i-1}$ and $F_{2i}$, can be used:

$$\overline{F}_{2i}+F_{2i}=1 \tag{8}$$

$$\overline{F}_{2i-1}+F_{2i-1}=1 \tag{9}$$

Figure 9:
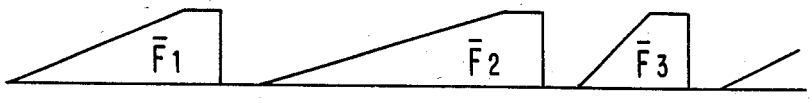
FIG. 9 and FIG. 10 are examples of other window functions.

FIG. 9 shows another example of the window funcion $\overline{F}_j$. In this case, flat portions are provided at the top of each triangle and between adjacent triangles. At the flat portions, the wave generator 100 changes the output waves.

In the above description, such window functions are used as triangles, trapezoids, and right angled triangles. These functions are easy to generate by known digital circuits. For example, they can be generated by counting the signal which is obtained by deviding the system clock. By using an up-down counter, symmetric triangles can be generated. By using an up counter or a down counter, right angled triangles can be generated. By changing the clock frequency applied to the counter, the inclination of a wave function can be varied. When the counter output turns to zero, the wave changing command is applied to the wave generators 1, 2 and 100.

The zero sections can be generated by stopping the clock once when all the counter outputs become zero. Further, a predetermined small number ΔF may be added repeatedly in order to generate the linearly increasing function. The function shown in FIG. 8(*c*) can be generated by resetting the value of the sum or by using the lowest k bits of the sum. In the latter case, (k+1)th bit of the sum can be used as a over-flow flag. So, it is preferable to change waves in response to assertion of (k+1)th bit of the sum.

In the case of using an adder/subtracter, the functions of FIGS. 2(*b*) and (*d*) can be generated by changing an addition to a subtraction. Also, it is preferable to change waves in response to the underflow of the result of the calculation. Such techniques as using the overflows or the underflows are usually employed for microcomputers. In this way, duration of each section can be set by properly selecting the value ΔF.

Next, methods to generate waves which lasts for a long time will be described. This is necessary when this invention is applied to electrical musical instruments. If the memory 101 has a large capacity, a long tone can be generated, but sooner or later the stored data will be read through to the end of the memory. When the data reading comes to the end of the memory, one of the following processes can be employed:

(1) The last value of the window function is held and the wave of the last section is read out repeatedly.

(2) At the end of the window function, the reading turns back to a previous window function, and to a previous wave which corresponds to a previous section.

In the case of (1) above, the output sound has no fluctuations with time. In the case of (2), sounds with fluctuation are obtained, because the wave of the predetermined sections are read out repeatedly.

The third method is as follows:

(3) The wave samples of the last wave are read out repeatedly, and at the timing of wave changing the same wave begins to be read out from the different start address. In this case, since phase modulation occurs with the window function, slight fluctuations are added to the resultant wave.

In the above, interpolations between two original waves have been described. However, more number of waves can be interpolated by using the following general form equation:

$$W_0(nT) = \sum_N WN_i(nT) \cdot FN_i(nT) \tag{10}$$

where,

N=I, II, III, . . .

i=section number.

In this case the interpolation deviates from the simple linear interpolation and is regarded as higher order interpolation.

Figure 10:
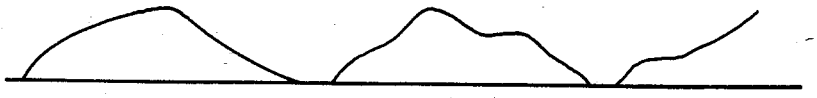

Further, in the foregoing, triangular functions and trapezoidal functions have been described as the window functions, but of cause quadratic curves and curves which have other shapes are usable as the window functions. In general, as shown in FIG. 10, any waves which has zero sections are usable as the window functions. By choosing the window function properly, we can get any desired sounds having natural fluctuations with time.

Superposing a reasonable modulating function on the window function will cause an amplitude modulation effect, because the amplitude modulation between plural waves will occur. This is expressed by the following equation:

$$\hat{F} = F + AM. \tag{11}$$

where, F is the original window function, AM is the superposed function, and F is the resultant window function. Of course the AM must be determined so that F takes value zero at the transition from one section to the next section. Instead of equation (11), the following equation (12) can be used as the window function:

$$\hat{F} = E \times F \tag{12}$$

In the equation (12), the window function F is obtained by multiplying original window function F by weighting function E. When the function is equal to the envelope function which is generated, for example, by the envelope generator 10 in FIG. 1, the envelope of the output sound can be controlled by the window function. Also the function E can be used for getting amplitude modulations.

In FIG. 1 and FIG. 7, the window functions are generated by the window function generators 3, 4 and 103, but they can be generated by reading out window function data stored in memories. The duration of each window function corresponds to the length of each wave section, and therefore it is desirable that the wave function generators generate the window functions with desired durations by reading out the section length data which are stored with the original waves in the memories 5, 6 and 101.

Further, the wave generators which generate waves by reading out the wave data from memories may be replaced by other types of wave generators which process the read out wave data or which generate the waves directly.

Figure 11:
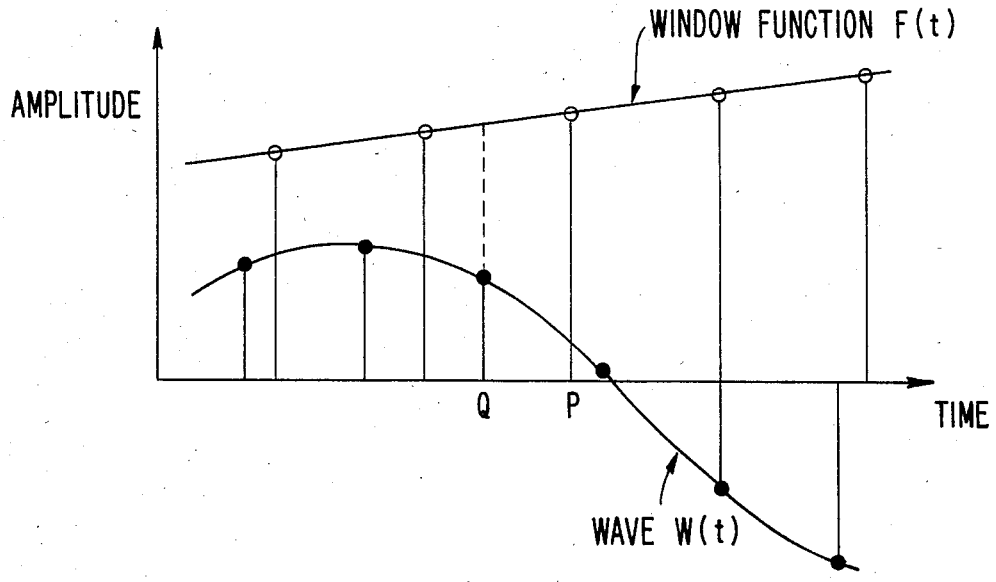
FIG. 11 is a waveform chart of a window function and a wave which are asynchronous with each other.

When the window functions are generated at the predetermined speed, the timing locations of the wave samples and the samples of the window functions are not exactly synchronized with each other, because the original waves are read out at varied speeds corresponding to the note frequencies of sounds to be generated. This situation is shown in FIG. 11. In this case, for the value of W×F at point Q, W(Q)×F(P) is taken instead of W(Q)×F(Q). Since the window function F(t) varies much more slowly than the wave W(t), there are no problems for practical use. Accordingly, generation of the waves and the window functions need not be synchronized with each other.

Figure 12:
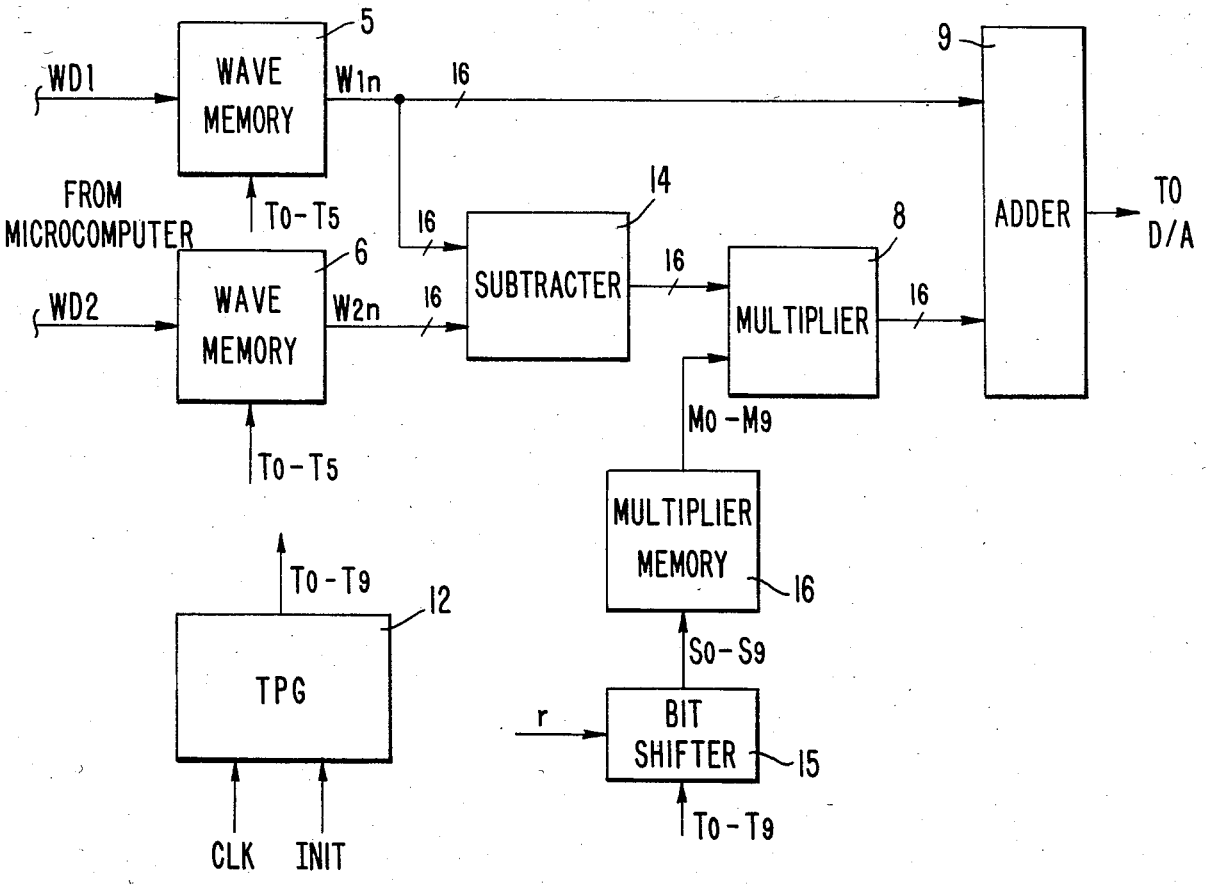
FIG. 12 is a schematic block diagram of still another embodiment of a wave generating apparatus of the present invention.
Figure 15:
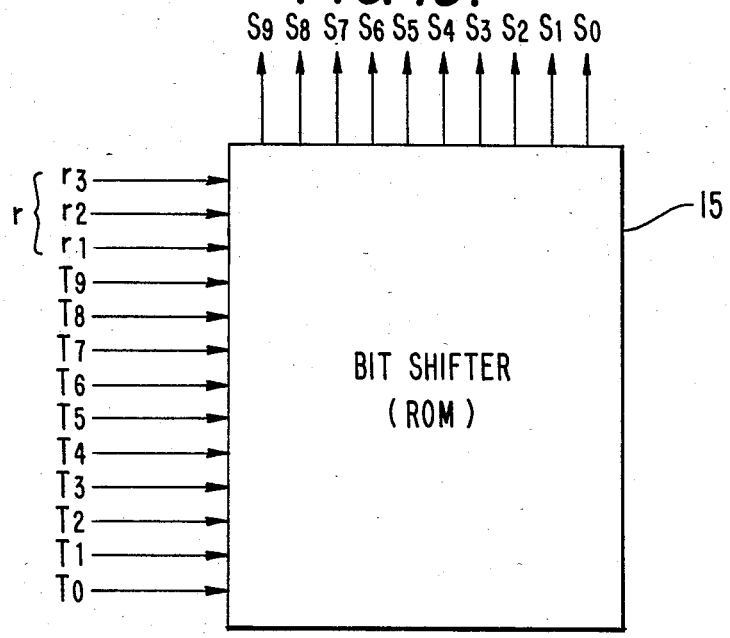
FIG. 15 is a schematic block diagram of a bit shifter 15 in FIG. 12.
Figure 19:
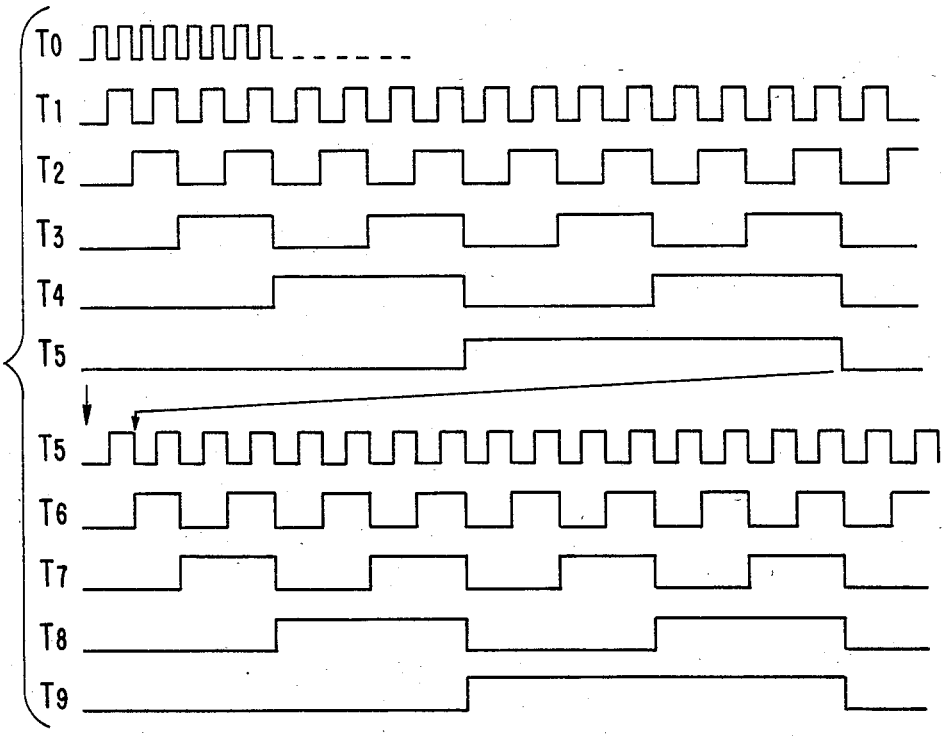
FIG. 19 is a timing diagram of outputs of TPG12 in FIG. 12.

FIG. 12 shows another embodiment of this invention. In FIG. 12, element 12 is a timing pulse generator (TPG, hereafter). The TPG12 determines timings of the apparatus and produces address data for memories which will be described later. The TPG12 comprises a 10 bit binary counter which is operated by a system clock CLK and outputs 10 signals from LBS $T_0$ to MSB $T_9$. These signals $T_0$–$T_9$ will be called "TD" in short, hereafter. A timing diagram of the TD is shown in FIG. 19. A signal INIT sets the TPG12 in its initial state. Elements 5 and 6 are wave memories. The wave memories 5 and 6 store the original waves which are taken out from audio signals each in one period length. Each of the wave memories 5 and 6 outputs samples which are specified by the address data whose upper parts are wave selecting data $WD_1$ and $WD_2$, and lower parts are $T_0$–$T_5$ of the TD from the TPG12. Element 14 is a subtracter which subtracts outputs of the wave memory 5 from outputs of the wave memory 6. Element 15 is a bit shifter which shifts the TD upward. The number of bits to be shifted corresponds to a repeat datum r given to the bit shifter 15. The bit shifter 15 can be comprised of a ROM (Read Only Memory), for example, as shown in FIG. 15. Element 16 is a multiplier memory which stores 1024 kinds of multiplier values of 10 bits and outputs one of the values specified by the address data supplied from the bit shifter 15. An example of the contents of the multiplier memory 16 is shown in Table 1.

In FIG. 12, element 8 is a multiplier which multiplies an output datum of the subtracter 14 with an output datum of the multiplier memory 16 and outputs a product datum. Element 9 is an adder which adds the output datum of the wave memory 5 and the output product of the multiplier 8 and outputs a sum value to a digital-to-analog converter (not shown in the Figure).

Next, operation of the wave generating apparatus in FIG. 12 will be described. First, for generating waves, wave selecting data $WD_1$ and $WD_2$ are applied to the wave memories 5 and 6, respectively, usually from a microcomputer (not shown). The address inputs of the wave memories 5 and 6 each consists of two parts: the upper part being wave selecting data $WD_1$ and $WD_2$; and the lower part being the lowest six bits $T_0$–$T_5$ of the TD from the TPG12, in this embodiment (the number of samples of a wave is 64). If the number of samples of a wave is 128, the lower part of each of the address inputs of the memories 5 and 6 is the lowest seven bits $T_0$–$T_6$ of TD. The upper part data $WD_1$ and $WD_2$ specify two read out waves and the lower part data $T_0$–$T_5$ specifies the sample number of the waves.

At the same time, the repeat datum r is applied to the bit shifter 15. The repeat datum r specifies the number which is equal to the value $R_i$ mentioned before of waves generated from the two original waves. The TPG12 is set in initial state by the signal INIT, and then begins to count the signal CLK. Following the counting of the TPG12, the wave memories 5 and 6 start outputting the samples of the two waves specified by $WD_1$ and $WD_2$ successively from the first sample. The lowest six bits $T_0$–$T_5$ of the TD are used as the lower part of the address data, in this embodiment, since the number of samples of each of the read out wave is 64. Accordingly, after all the 64 samples are outputted, if there is no change in $WD_1$ and $WD_2$ the wave memories 5 and 6 restart to output the samples of the same wave from the first sample again. Let the the n-th samples of the waves output from the wave memories 5 and 6 be $W_{1n}$ and $W_{2n}$ respectively, then the subtracter 14 outputs the value $(W_{2n}-W_{1n})$.

Next, the way to generate multiplier numbers will be described. The relationship between the repeat datum r and the number $R_i$ of waves to be generated is shown in Table 2.

Figure 13:
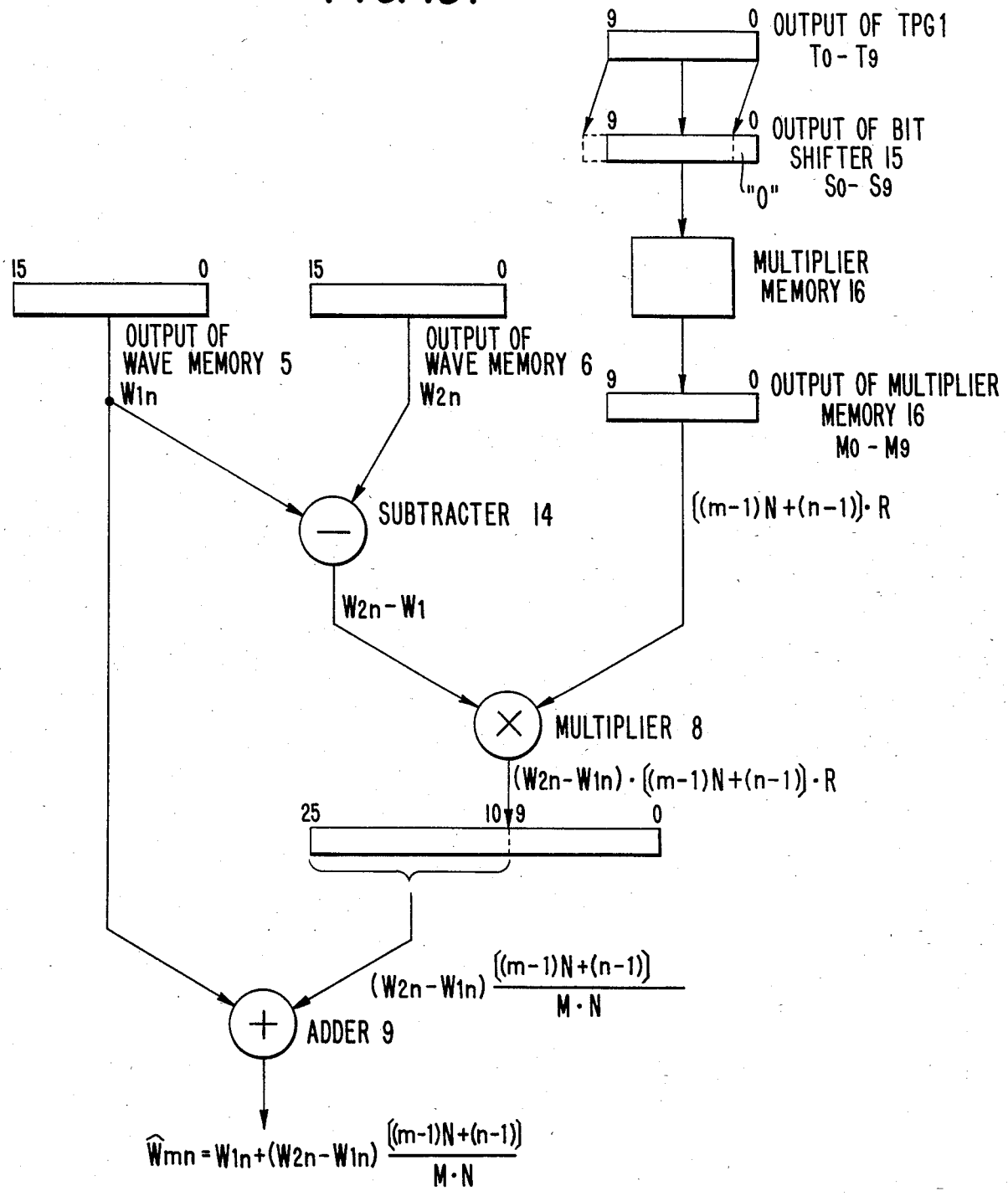
FIG. 13 is a data flowchart used to explain calculations for generating a wave by the apparatus of FIG. 12.

Referring now to FIG. 13, we will describe the operations of the bit shifter 15, the multiplier memory 16, and the multiplier 8. The TD, the output of the TPG12, are shifted by r bits upward by the bit shifter 15. As an example, if the number of waves to be generated is 4, r is 2 and the bit shifter 5 shifts the input data TD 2 bits upward. So, the relation between TD, $T_0$–$T_9$, and output $M_0$–$M_9$ (MD, hereafter) of the multiplier memory 16 is as shown in Table 3.

Figure 14:
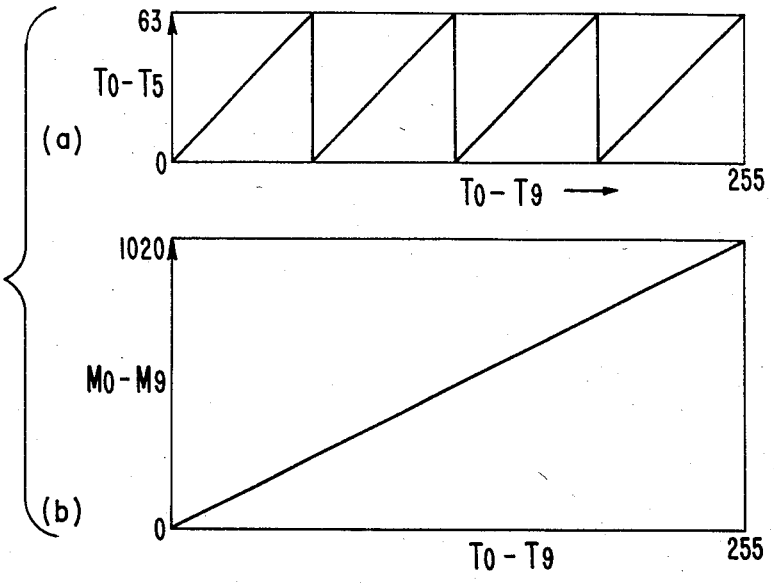
FIG. 14 is a chart used to explain the operation of TPG12 in FIG. 12.

In this case, as shown in FIG. 14(*a*), during the time when TPG1 counts up from 0 to 255, $T_0$–$T_5$ change from 0 to 63 four times repeatedly. So, each of the wave memories 5 and 6 outputs the same wave four times since the lower address thereof is $T_0$ –$T_5$. Also, as shown in FIG. 14(*b*), during the time when the TD counts up from 0 to 255 and each of the wave memories 5 and 6 outputs the same wave four times, the output $M_0$–$M_9$ (MD) of the multiplier memory 16 increase from 0 to 1020 at intervals of 4.

Next, the interpolation executed by this embodiment will be described. As described before, the lowest bits of the TD specifies the sample number of the waves. When the number of bits which specify the sample number of the waves is $\nu$, the number of samples of a wave is $2^{\nu}$. So, when the number of samples of a wave is N, and the number of waves to be generated is M, and still the repeat datum r is 2, then the value of M is 4, and the value of MD is expressed by the following formula:

$$[(m-1)\cdot N+(n-1)]\times 4$$

where, $1 \leqq m \leqq M$, $1 \leqq n \leqq N$.

In this formula, the value 4 at the end means that MD, the output of the multiplier memory 16, increases by increments of 4. Generally, this increment value is represented as follows:

$$R = \frac{1024}{M \cdot N} \tag{13}$$

So, the above formula is rewritten as follows;

$$[(m-1)\cdot N+(n-1)]\cdot R. \tag{14}$$

The multiplier 8 multiplies this MD of 10 bits and the output datum of 10 bits of the subtractor 14. Then, the upper 16 bits of the output of 26 bits of the multiplier 8 are applied to the adder 9, which means that the output of 26 bits of the multiplier 8 is shifted downward by 10 bits. This also means that the output of the multiplier 8 is dvided by 1024. Thus, according to this process, the output data of the subtracter 14 and the value which linearly increase from $$0 \text{ to } \frac{1020}{1024} \approx 0.996$$

are multiplied while TPG12 counts up from 0 to 255.

At the instance when the TPG12 counts 256, the value of the lowest 6 bits of the TD becomes zero, and consequently a wave changing signal is sent out to the microcomputer which supplies the wave specifying data $WD_1$ and $WD_2$ to the wave memories 5 and 6. The microcomputer changes the wave specifying data $WD_1$ and $WD_2$ in response to the wave changing signal.

Next, referring again to FIG. 13, the procedure of interpolation calculation will be described. The wave samples $W_{1n}$ and $W_{2n}$ which are read out from the wave memories 5 and 6, are applied to the subtracter 14 to obtain the differential datum $(W_{2n}-W_{1n})$. The datum $(W_{2n}-W_{1n})$ is multiplied by the multiplier number shown by the equation (14) at the multiplier 8 to obtain the value $(W_{2n}-W_{1n})\cdot[(m-1)\cdot N+(n-1)]\cdot R$. But, from equation (13), $M\cdot N\cdot R=1024$. So the value of the upper 16 bits of the multiplier 8 output is expressed as follows:

$$(W_{2n}-W_{1n})\frac{[(m-1)N+(n-1)]}{M\cdot N} \tag{15}$$

This value and the output $W_{1n}$ of the wave memory 5 are added at the adder 9 to obtain an interpolated value:

$$\hat{W}_{mn}=W_{1n}+(W_{2n}-W_{1n})\frac{[(m-1)N+(n-1)]}{M\cdot N} \tag{16}$$

This equation (16) is used to obtain the sample $\hat{W}_{mn}$ which is the n-th sample of the m-th output wave generated from the two selected waves. Needless to say, equation (16) can be variously modified so as to obtain the same effect.

Here, let the analog waves which correspond to $W_{1n}$, $W_{2n}$ be $W_1(t)$, $W_2(t)$ respectively, then they are expressed as follows:

$$W_1(t)=\sum_{i=-\infty}^{\infty} C_{1i}e^{j2\pi fit} \tag{17}$$

$$W_2(t)=\sum_{i=-\infty}^{\infty} C_{2i}e^{j2\pi fit} \tag{18}$$

where, $C_{1i}$, $C_{2i}$ are the complex Fourier spectra of i-th harmonic component, f is the fundamental frequency of the waves, $W_1(t)$, $W_2(t)$, and j is $\sqrt{-1}$. Accordingly, if the W(t) is the analog value corresponding to $W_{mn}$, it is expressed as follows:

$$\hat{W}(t)=\sum_{i=-\infty}^{\infty}[C_{1i}+(C_{2i}-C_{1i})\frac{(m-1)N+(n-1)}{M\cdot N}\times e^{j2\pi fit} \tag{19a}$$

$$=\sum_{i=-\infty}^{\infty}\hat{C}_{mni}e^{j2\pi fit} \tag{19b}$$

where, $$\hat{C}_{mni}=C_{1i}+(C_{2i}-C_{1i})\frac{(m-1)N+(n-1)}{M\cdot N} \tag{19c}$$

The numerator $(m-1)N+(n-1)$ of $$\frac{(m-1)N+(n-1)}{M\cdot N}$$

in the equation (19c) increases from 0 to $MN-1$ with increments of one, during from the time that the first sample $W_{11}$ is sent out to the time that the last sample $W_{MN}$ is sent out. Accordingly, the equation (19c) means that the instant Fourier spectra $C_{mni}$ of $W_{mn}$ approaches to $C_{2i}$ from $C_{1i}$ continuously.

Figure 16:
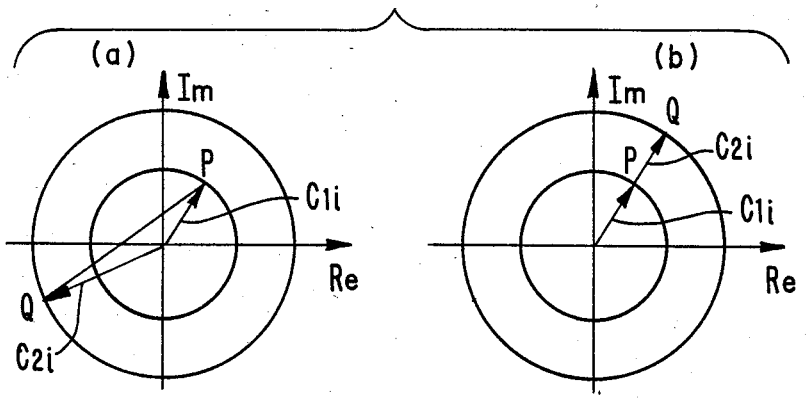

FIG. 16(*a*) shows a complex Fourier spectrum of a harmonic component of the wave $\hat{W}(t)$ as a vector on the complex plane. The end of the vector $\hat{C}_{mni}$ contineously moves from P to Q on the line PQ, when the wave whose number of total samples is M·N is generated. As can be seen in equation (19b), W(t) is completely continuous in amplitude and phase for each harmonic component. Consequently, smooth and natural output audio signals can be obtained.

Furthermore, previously adjusting the phases of the same order harmonic components of the two chosen waves to have the same value, equations (17) and (18) are expressed as follows:

$$W_1(t)=\sum_{i=-\infty}^{\infty}|C_{1i}|e^{j\phi_i}e^{j2\pi fit} \tag{20}$$

$$W_2(t)=\sum_{i=-\infty}^{\infty}|C_{2i}|e^{j\phi_i}e^{j2\pi fit}, \tag{21}$$

and equations (19) is expressed as follows:

$$\hat{W}_{mn}= \tag{22a}$$

$$\sum_{i=-\infty}^{\infty}\left[|C_{1i}|+(|C_{2i}|-|C_{1i}|)\frac{(m-1)N+(n-1)}{M\cdot N}\right]\times e^{j\phi_i}e^{j2\pi fit}$$

$$=\sum_{i=-\infty}^{\infty}C_{mni}e^{j2\pi fit} \tag{22b}$$

where $$\hat{C}_{mni}=\left\{|C_{1i}|+(|C_{2i}|-|C_{1i}|)\frac{(m-1)N+(n-1)}{M\cdot N}\right\}\times e^{j\phi_i} \tag{22c}$$

Figure 17:
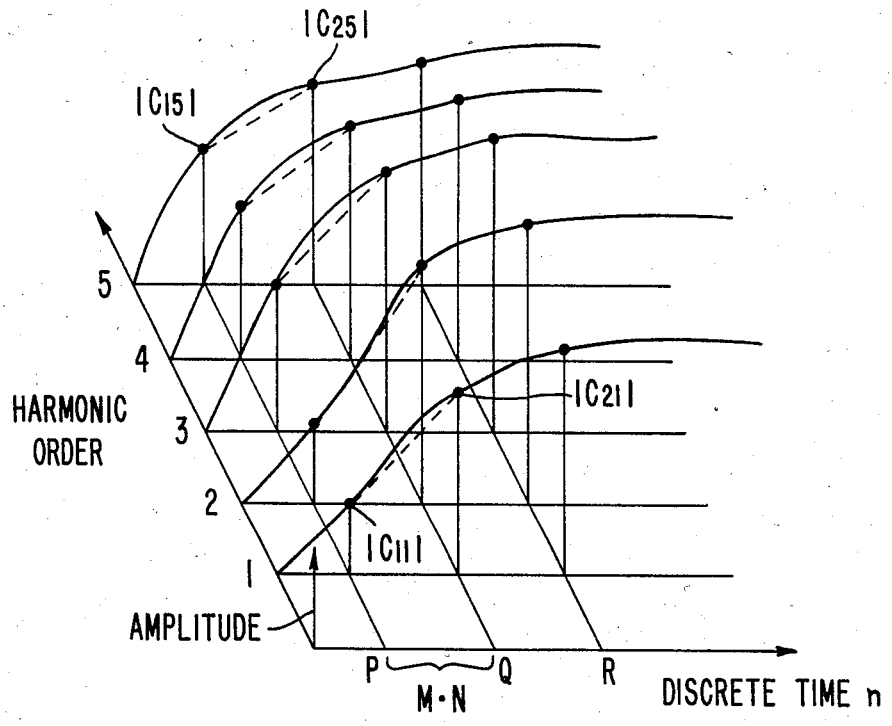
FIG. 17 and FIG. 18 are three dimensional graphic chart showing amplitude envelopes of components of waves.

Equation (22) means that the amplitude of the instant Fourier spectra of $\hat{W}_{mn}$ and $\hat{C}_{mni}$ changes from $|C_{1i}|$ to $|C_{2i}|$ continuously and linearly. FIG. 16(*b*) shows this state. The complex Fourier spectrum is expressed as a vector on the complex plane. By previously adjusting the phases of the same order harmonic components of the two chosen waves to have the same value transitions of the amplitude envelope of each component can be approximated by piece-wise linear lines. For example, FIG. 17 shows the amplitude envelopes of the lowest five components. To approximate those envelopes from P to Q for each component, the following two waves are used:

(1) a wave having the components whose amplitudes are the values at the time P; and (2) a wave having the components whose amplitudes are the values at the time Q.

Further, phases of the same order components of those two waves are adjusted to have the same value.

Figure 18:
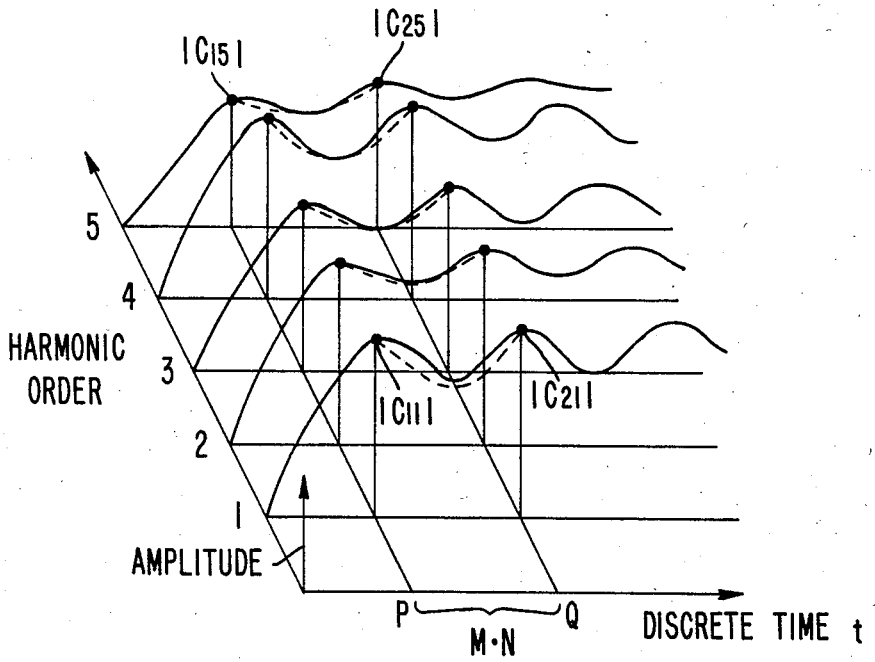

FIG. 18 shows the case that the amplitude envelopes of components of a sound have amplitude fluctuations on tremolo. In this case, the curve of each amplitude envelope between P and Q can be approximated as indicated by the broken lines. For achieving this, a wave, as the first wave, whose amplitude spectra are at point P and the other wave, as the second wave, whose amplitude spectra are at point Q are provided, and the phases of the same order components of these two waves are made adequately different from each other. It is because, as shown in FIG. 16(*a*), when there is a difference between the phases of the same order components of the these two waves, $|\hat{C}_{mni}|$ gets closer to $|C_{2i}|$ after becoming smaller than $|C_{1i}|$ once on the way. And the curve is decided by the difference of those phases. So, by choosing the adequate difference, an adequately approximated curve is obtained.

Furthermore, as shown in FIG. 16(*a*), in the case that the phase of the k-th component of the first wave is more advanced than that of the second wave, the phase of the k-th component of the resultant wave advances gradually, so that the frequency of that component becomes a little bit higher. On the other hand, in the case that the phase of the k-th component of the first wave is less advanced than that of the second wave, the phase of the k-th component of the resultant wave delays gradually, so that the frequency of that component becomes a little bit lower.

Using this phenomena, the vibrato effect or inharmonicity can be produced in the generated sound. That is, for obtaining the vibrato effect the phase difference is made to alternate between positive and negative values, and for obtaining the inharmonicity the phase differences are made to change with the order of components.

In the foregoing embodiments, the contents of the multiplier memory 16 are the same as the outputs of the bit shifter 15, which are the address inputs of the multiplier memory 16. So, as shown in FIG. 14(*b*), the differential value $(W_{2n}-W_{1n})$ increases with a constant increment for each step. But it is possible to set the increasing step freely by changing the contents of the multiplier memory 16. In other words, the amplitude envelope can be approximated from P to Q in FIG. 17 by curves instead of the piece-wise linearlines. That is, by memorizing higher order curves in the multiplier memory 16, any desired interpolations can be executed in order to generate more natural sound waves.

In the foregoing description, we have explained how to generate a wave from two waves. But furthermore, the two waves can be a wave of M·N samples by adopting the wave at point P as the first wave and the wave at point Q as the second wave, the wave at point Q is adopted as the first wave and the wave at point P as the second wave to generate the resultant wave from these new pair of waves again. In this way, we can obtain a output sound whose amplitude envelopes of the components are piece-wise linearly approximated.

Needless to say, the plural wave generators can be replaced by a single wave generator by using known time dividing multiplexing technique.

In the foregoing, some preferred embodiments have been described, but they are only for explanation and are not to limit the scope of the invention. Therefore, it should be understand that various changes and modifications are possible within the scope of the present invention, and the scope of the present invention should be considered from the appended claims.

TABLE 1

| Address S0–S9 (decimal) | Data M0–M9 (decimal) |
|---|---|
| 0 | 0 |
| 1 | 1 |
| 2 | 2 |
| 3 | 3 |
| 1021 | 1021 |
| 1022 | 1022 |

TABLE 1-continued

| Address S0–S9 (decimal) | Data M0–M9 (decimal) |
|---|---|
| 1023 | 1023 |

TABLE 2

| r (decimal) | Ri (decimal) |
|---|---|
| 0 | 16 |
| 1 | 8 |
| 2 | 4 |
| 3 | 2 |
| 4 | 1 |

TABLE 3

| TD (decimal) | MD (decimal) |
|---|---|
| 0 | 0 |
| 1 | 4 |
| 2 | 8 |
| 253 | 1012 |
| 254 | 1016 |
| 255 | 1020 |

What is claimed is:

1. A wave generating method comprising the steps of:

generating a plurality of waves having a same period and containing different harmonic components from one another, phase differences among same order harmonic components of said plurality of waves being predetermined phase differences;

generating a plurality of window functions corresponding to said plurality of waves, quantities of said plurality of window functions varying gradually with durations longer than the period of said plurality of waves;

multiplying said plurality of waves by said plurality of window functions, respectively; and adding the multiplied results to obtain a sound wave;

wherein each of said plurality of waves is changed to a new kind of wave when the quantity of corresponding one of said plurality of window functions becomes zero.

2. The method according to claim 1, wherein a sum of said plurality of window functions is constant.

3. The method according to claim 2, wherein the wave form of each of said plurality of window functions is triangular.

4. The method according to claim 1, wherein said predetermined phase differences are zero.

5. The method according to claim 4, wherein a sum of said plurality of window functions is constant.

6. The method according to claim 5, wherein the wave form of each of said plurality of window functions is triangular.

7. A wave generating method comprising the steps of:

preparing a plurality of original waves of one period length which are obtained from natural sound or musical sound and contain different harmonic components from one another;

processing said plurality of original waves so that phase differences among same order harmonic components of said plurality of original waves becomes predetermined phase differences thereby to obtain a plurality of waves;

generating a plurality of window functions corresponding to said plurality of waves, quantities of said plurality of window functions varying gradually with durations longer than the period length of said plurality of waves;

multiplying said plurality of waves by said plurality of window functions, respectively; and adding the multiplied results to obtain a sound wave; wherein each of said plurality of waves is changed to a new kind of wave when the quantity of corresponding one of said plurality of window functions becomes zero.

8. The method according to claim 7, wherein said predetermined phase differences are zero.

9. A wave generating apparatus comprising:

a plurality of wave generating means generating a plurality of waves having a same period and containing different harmonic components from one another, phase differences among same order harmonic components of said plurality of waves being predetermined phase differences;

a plurality of window function generating means generating a plurality of window functions corresponding to said plurality of waves, quantities of said plurality of window functions varying gradually with durations longer than the period of said plurality of waves;

a plurality of multiplying means for multiplying said plurality of waves by said plurality of window functions, respectively;

an adding means for adding outputs of said plurality of multiplying means; and at least one wave changing means responsive to said plurality of window functions for changing each of said plurality of waves to a new kind of wave when the quantity of corresponding one of said window functions becomes zero.

10. The apparatus according to claim 9, wherein a sum of said plurality of window functions is constant.

11. The apparatus according to claim 10, wherein the wave form of each of said plurality of waves is triangular.

12. The apparatus according to claim 9, wherein said predetermined phase differences are zero.

13. The apparatus according to claim 12, wherein a sum of said plurality of window functions is constant.

14. The apparatus according to claim 13, wherein the wave form of each of said plurality of waves is triangular.

15. A wave generating apparatus comprising:

at least one memory means for storing a plurality of waves of one period length obtained from a plurality of original waves which are extracted from natural sound or musical sound and contain different harmonic components from one another, phase differences among same order harmonic components of said plurality of waves being predetermined phase differences;

at least one reading out means for reading out two waves of said plurality of waves at the same time from said memory means;

at least one window function generating means generating two window functions corresponding to said two waves at the same time, quantities of said two window functions varying gradually with durations longer than the period length of said plurality of waves;

at least one multiplying means for multiplying said two waves by said two window functions, respectively;

an adding means for adding the multiplied results from said multiplying means thereby to obtain a sound wave; and at least one wave changing means responsive to said two window functions for producing a wave changing signal when the quantity of at least one of said two window functions becomes zero, said wave changing signal being applied to said reading out means so that said reading out means reads out another kind of wave of said plurality of waves from said memory means in place of one of said two waves corresponding to said one of said two window functions which has become zero.

16. The apparatus according to claim 15, wherein a sum of said two window functions is constant.

17. The apparatus according to claim 16, wherein the wave form of each of said plurality of waves is triangular.

18. The apparatus according to claim 15, wherein said predetermined phase differences are zero.

19. The apparatus according to claim 18, wherein a sum of said two window functions is constant.

20. The apparatus according to claim 19, wherein the wave form of each of said plurality of waves is triangular.

21. A wave generating apparatus comprising:

at least one memory means for storing a plurality of waves of one period length obtained from a plurality of original waves which are extracted from natural sound or musical sound and contain different harmonic components from one another, phase differences among same order harmonic components of said plurality of waves being predetermined phase differences;

at least one reading out means for reading out two waves $W_1$ and $W_2$ of said plurality of waves from said memory means;

a substracting means for subtracting said wave $W_1$ from said wave $W_2$ so as to obtain a wave $W_2-W_1$;

a window function generating means generating a window function F the quantity of which increases gradually from 0 to 1 and thereafter decreases gradually from 1 to 0 during a period longer than the period length of said plurality of waves;

a multiplying means for multiplying said wave $W_2-W_1$ by said window function F so as to obtain a wave $(W_2-W_1)\times F$;

an adding means for adding said wave $W_1$ with said wave $W_2-W_1)\times F$ so as to obtain a wave $W_1+(W_2-W_1)\times F$; and a wave changing means responsive to said window function F for producing a wave changing signal when the quantity of said window function F becomes zero, said wave changing signal being applied to said reading out means so that said reading out means reads out another kind of wave $W_3$ of said plurality of waves from said memory in place of one of said two waves $W_1$ and $W_2$.

* * * * *